US009109411B2

(12) United States Patent
Shampine et al.

(10) Patent No.: US 9,109,411 B2
(45) Date of Patent: Aug. 18, 2015

(54) PRESSURE PULSE DRIVEN FRICTION REDUCTION

(75) Inventors: Rod Shampine, Houston, TX (US); Larry J. Leising, Missouri City, TX (US); Shunfeng Zheng, Katy, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 404 days.

(21) Appl. No.: 13/528,188

(22) Filed: Jun. 20, 2012

(65) Prior Publication Data

US 2012/0318531 A1 Dec. 20, 2012

Related U.S. Application Data

(60) Provisional application No. 61/498,845, filed on Jun. 20, 2011.

(51) Int. Cl.
*E21B 19/08* (2006.01)
*E21B 47/01* (2012.01)
*E21B 23/14* (2006.01)

(52) U.S. Cl.
CPC ..... *E21B 19/08* (2013.01); *E21B 23/14* (2013.01); *E21B 47/01* (2013.01)

(58) Field of Classification Search
CPC ..... E21B 7/24; E21B 31/005; E21B 28/00; E21B 31/00; E21B 7/00; E21B 7/04; E21B 33/13; E21B 33/14; E21B 23/14; E21B 19/08; E21B 47/01; E21B 17/023; E21B 23/00
USPC ..... 166/249, 177.6, 177.1, 177.2, 301, 166/250.01, 385, 77.1, 241.5; 175/56; 137/14, 388
See application file for complete search history.

(56) References Cited

U.S. PATENT DOCUMENTS

| | | | |
|---|---|---|---|
| 3,155,163 | A | 11/1964 | Bodine |
| 4,384,625 | A | 5/1983 | Roper et al. |
| 4,574,888 | A | 3/1986 | Vogen |
| 4,576,229 | A | 3/1986 | Brown |
| 4,667,742 | A | 5/1987 | Bodine |
| 4,890,682 | A | 1/1990 | Worrall et al. |
| 4,913,234 | A | 4/1990 | Bodine |
| 5,448,911 | A | 9/1995 | Mason |

(Continued)

FOREIGN PATENT DOCUMENTS

| | | | |
|---|---|---|---|
| GB | 2275342 | A | 8/1994 |
| WO | 9735093 | A1 | 9/1997 |
| WO | 2010125405 | A2 | 11/2010 |

OTHER PUBLICATIONS

Underhill, William B. , "A Predictive Model for Wireline Tool Sticking", SWS-HPC, Engineering Report: Advanced Studies Engineering Report #17, Jun. 19, 1997, 40 pages.

(Continued)

*Primary Examiner* — Yong-Suk (Philip) Ro
(74) *Attorney, Agent, or Firm* — Michael L. Flynn; Timothy Curington; Robin Nava

(57) ABSTRACT

A method for reducing friction between a coiled tubing and a wellbore includes: generating a periodic pressure wave; coupling the periodic pressure wave to a coiled tubing in a wellbore; and propagating the periodic pressure change in the coiled tubing wherein a friction force between the coiled tubing and the wellbore is reduced. The shape of the periodic pressure wave can be modulated to a form similar to that of a sinusoidal waveform.

19 Claims, 4 Drawing Sheets

(56) References Cited

U.S. PATENT DOCUMENTS

| | | | | |
|---|---|---|---|---|
| 6,009,948 | A | 1/2000 | Flanders et al. | |
| 6,079,505 | A * | 6/2000 | Pignard et al. | 175/40 |
| 6,412,560 | B1 | 7/2002 | Bernat | |
| 6,439,318 | B1 | 8/2002 | Eddison et al. | |
| 6,464,014 | B1 | 10/2002 | Bernat | |
| 6,550,536 | B2 | 4/2003 | Bernat | |
| 6,571,870 | B2 | 6/2003 | Zheng et al. | |
| 6,845,818 | B2 | 1/2005 | Tutuncu et al. | |
| 6,907,927 | B2 | 6/2005 | Zheng et al. | |
| 7,139,219 | B2 | 11/2006 | Kollé et al. | |
| 7,219,726 | B2 | 5/2007 | Zheng et al. | |
| 7,575,051 | B2 | 8/2009 | Stoesz et al. | |
| 7,637,321 | B2 | 12/2009 | Zazovsky et al. | |
| 7,708,088 | B2 | 5/2010 | Allahar et al. | |
| 7,757,793 | B2 | 7/2010 | Voronin et al. | |
| 7,874,362 | B2 | 1/2011 | Coates et al. | |
| 8,042,623 | B2 | 10/2011 | Quernheim et al. | |
| 8,636,062 | B2 | 1/2014 | Fripp et al. | |
| 2005/0284624 | A1 | 12/2005 | Libby et al. | |
| 2006/0054315 | A1 | 3/2006 | Newman | |
| 2007/0256828 | A1 | 11/2007 | Birchak et al. | |
| 2008/0073085 | A1 | 3/2008 | Lovell et al. | |
| 2008/0251254 | A1 | 10/2008 | Lynde et al. | |
| 2010/0276204 | A1 | 11/2010 | Connell et al. | |
| 2011/0203395 | A1 | 8/2011 | Pfahlert | |
| 2011/0267922 | A1 | 11/2011 | Shampine et al. | |
| 2012/0132289 | A1 * | 5/2012 | Kolle | 137/14 |
| 2012/0318531 | A1 | 12/2012 | Shampine et al. | |

OTHER PUBLICATIONS

Castaneda, et al., "Coiled Tubing Milling Operations: Successful Application of an Innovative Variable Water Hammer Extended-Reach BHA to Improve End Load Efficiencies of a PDM in Horizontal Wells", SPE 143346—SPE/ICoTA Coiled Tubing Conference & Well Intervention Conference and Exhibition, The Woodlands, Texas, USA, Apr. 5-6, 2011, pp. 1-19.

Dupriest, et al., "Design Methodology and Operation Practices Eliminate Differential Sticking", SPE 128129—IADC/SPE Drilling Conference and Exhibition, New Orleans, Louisiana, USA, 2010, pp. 1-13.

Newman, Kenneth R., "Vibration and Rotation Considerations in Extending Coiled-Tubing Reach", SPE 106979 —SPE/ICoTA Coiled Tubing and Well Intervention Conference and Exhibition, The Woodlands, Texas, U.S.A., 2007, pp. 1-9.

Robertson, et al., "Dynamic Excitation Tool: Developmental Testing and CTD Field Case Histories", SPE 89519—SPE/ICoTA Coiled Tubing Conference and Exhibition, Houston, Texas, Mar. 23-24, 2004, pp. 1-16.

Sola, Kjell-Inge, "New Downhole Tool for Coiled Tubing Extended Reach", SPE 60701—SPE/ICoTA Coiled Tubing Roundtable, Houston, Texas, Apr. 5-6, 2000, 8 pages.

Stoesz, et al., "Low-Frequency Downhole Vibration Technology Applied to Fishing Operations", SPE 63129—SPE Annual Technical Conference and Exhibition, Dallas, Texas, 2000, pp. 1-7.

* cited by examiner

PRESSURE PULSE DRIVEN FRICTION REDUCTION

RELATED APPLICATION DATA

This application claims priority of U.S. Provisional Patent Application Ser. No. 61/498,845 filed Jun. 20, 2011, which is incorporated by reference herein in its entirety.

BACKGROUND

The statements made herein merely provide information related to the present disclosure and may not constitute prior art, and may describe some embodiments illustrating the present disclosure. All references discussed herein, including patent and non-patent literatures, are incorporated by reference into the current application.

At the outset, it should be noted that in the development of any such actual embodiment, numerous implementation-specific decisions must be made to achieve the developer's specific goals, such as compliance with system related and business related constraints, which will vary from one implementation to another. Moreover, it will be appreciated that such a development effort might be complex and time consuming but would nevertheless be a routine undertaking for those of ordinary skill in the art having the benefit of this disclosure. In addition, the composition used/disclosed herein can also comprise some components other than those cited. In the summary and this detailed description, each numerical value should be read once as modified by the term "about" (unless already expressly so modified), and then read again as not so modified unless otherwise indicated in context. Also, in the summary and this detailed description, it should be understood that a concentration range listed or described as being useful, suitable, or the like, is intended that any and every concentration within the range, including the end points, is to be considered as having been stated. For example, "a range of from 1 to 10" is to be read as indicating each and every possible number along the continuum between about 1 and about 10. Thus, even if specific data points within the range, or even no data points within the range, are explicitly identified or refer to only a few specific, it is to be understood that inventors appreciate and understand that any and all data points within the range are to be considered to have been specified, and that inventors possessed knowledge of the entire range and all points within the range.

In oilfield operations involving coiled tubing, there is a fundamental limitation to the length of horizontal well that can be entered by the coiled tubing. This is primarily due to the friction between the coiled tubing and the wellbore. This friction produces an axial force in the coiled tubing directed against the motion of the coiled tubing, which, in turn, may eventually cause the coiled tubing to form into a sine wave and then a helix inside the wellbore. Once this has happened, any axial force applied from the surface produces a radial force that increases the frictional force resisting the motion of the coiled tubing into the hole. At some point during travel, the coiled tubing stops moving and begins to lock up, as will be appreciated by those skilled in the art. Conventional methods that have been applied to this problem include straightening the coiled tubing to cause it to resist starting to helix, using thicker and stiffer coiled tubing at the vulnerable section (instead of the usual taper where the thinnest wall is at the bottom), and using friction reducing compounds in the pumped fluid. Unconventional solutions include coiled tubing tractors, pumping glass beads, and downhole vibrators. Such vibrators act to produce small relative motions between the coiled tubing and the wellbore in the hopes of reducing the coefficient of friction and/or change it from static to dynamic friction.

However, there remains a need to further improve the system and method for reducing friction between coiled tubing and a wellbore penetrating subterranean formation.

SUMMARY

In the present disclosure, a pressure pulse or pressure wave is applied to the inlet (at or near the surface equipment) of the coiled tubing and allowed to propagate through the coiled tubing down to the bottom (or end of the coiled tubing in the wellbore). Alternatively, the pressure pulse may be generated downhole or generated in the annulus. Alternatively, the pressure pulse may be generated at the surface and applied to the annulus. Pulsing the inlet of the coiled tubing provides the satisfactory energy transfer downhole. In the case where the pressure pulse is higher than the continuous pumping pressure, the section of coiled tubing that contains the pressure pulse is caused to expand relative to the rest of the coil and to get longer relative to sections that are at the continuous pumping pressure. In the case where the pressure pulse is lower than the continuous pumping pressure, the section of coiled tubing that contains the pressure pulse is caused to shrink relative to the rest of the coil and to get shorter relative to sections that are at the continuous pumping pressure. Either condition, or a combination of them (including a specially shaped pulse train), will produce a traveling wave of motion going from the top of the coiled tubing to the bottom.

A negative pulse may be particularly beneficial because a negative pulse is relatively easier to generate compared to a positive pulse and the coiled tubing will move into the hole not less than the amount of shortening due to the pressure pulse. This is due to the weight of the vertical coiled tubing pushing against the helically buckled section. This weight will cause the upper section to move downhole with the pulse, and then the helix will re-lock behind the pulse. Alternatively, the pulses may produce relative motion sufficient to convert from static friction to dynamic friction and/or produce dynamic lubrication. Further, the reflection of the pulse from the tool will also produce a second upward traveling wave of significant magnitude. The pulse reflecting off of the tool will further produce a significant shock at the tool without the need of a specialized shock generating tool.

Depending on the specific condition of a system, such as the helical buckling wave length of the coiled tubing, an optimum pulse length and/or pulse train may be determined to maximize the effect of the pressure pulse. Stated in other words, in one embodiment, the length of a pressure pulse is determined in relation to the buckling period of the coiled tubing.

The method disclosed herein may be particularly attractive in that it can be applied after the coiled tubing is in hole and has become stuck. Also, it does not require special downhole tools and/or pre-job preparations. The pressure pulses can be generated with as little as two standard hammer valves and a joint of treating iron. One hammer valve is the pulse generating valve (the "popper valve") and may be connected between the joint of treating iron and a point near the swivel. The other end of the joint has another hammer valve (the "fill" valve). A choke nipple on the outlet of the second valve can be optionally provided. In operation, the following steps may be applied: (1) closing both valves; (2) starting pumping; (3) opening the fill valve; (4) optionally, draining the joint for additional energy storage, or using water compression alone; (5) closing the fill valve; (6) opening the popper valve as fast as possible; (7) allowing the pulse to propagate through the system; (8) closing the popper valve; and (9) repeating the above steps as needed. A portion or the entire procedure described above can be automated. The equipment described above and herein may be capable of generating pressure pulses whose physical dimensions are in the range of 50 to 200 feet long when passing through coiled tubing. Modifications may be implemented to allow this distance to be shortened, extended, or modified into more complex wave shapes, as will be appreciated by those skilled in the art.

Other methods and equipment of generating pressure pulses can be used in the current application as well. Examples include, but are not limited to, those disclosed in co-assigned, co-pending U.S. patent application Ser. No. 13/015,985 (and having an internal docket number of 56.1381), the entire content of which is incorporated by reference into the current application such as, but not limited to, a fracturing pump disposed at a wellsite having a drilled valve assembly. The wellsite setup of the pressure pulse generation system can take various forms. One example has been disclosed in U.S. Pat. No. 7,874,362, the entire content of which is incorporated by reference into the current application.

A method for reducing friction between a coiled tubing and a wellbore according to the present disclosure includes: generating a pressure wave; introducing the pressure wave to a coiled tubing positioned in a wellbore; and propagating the pressure wave within the coiled tubing wherein the pressure wave reduces a friction force between the coiled tubing and the wellbore. The step of generating can include generating the pressure wave at an oilfield surface, at a bottom of the wellbore, or in an annulus of the wellbore. The step of generating can include generating the pressure wave at about 500 feet long in wavelength. The pressure wave can be generated as a positive pressure pulse exceeding a continuous pressure in the coiled tubing and can be up to about 6000 psi in pressure. The pressure wave can be generated as a negative pressure pulse less than a continuous pressure in the coiled tubing and can be up to about 5000 psi in pressure.

The step of generating can include generating the pressure wave by operating two valves in fluid connection by a joint of treating iron. The step of generating can include generating the pressure wave at a predetermined frequency and/or a predetermined wavelength. The predetermined frequency can be determined in relation to at least one of a total acoustic length of the coiled tubing, a helical buckling length or pitch of the coiled tubing, and a length of the coiled tubing disposed in the wellbore.

The method further can include a step of measuring an axial acceleration of the coiled tubing and adjusting the generated pressure wave based on the measured acceleration. The step of measuring can include measuring the axial acceleration of the coiled tubing at a wellsite surface or a bottom hole assembly.

The steps of generating, introducing, and propagating can be performed by modulating operation of a pump attached to the coiled tubing. The method can include a step of measuring an axial force at a downhole end of the coiled tubing and adjusting the generated pressure wave based on the measured axial force. The method can include wherein a frequency of the pressure wave is adjusted based on a length of the coiled tubing in the wellbore. The frequency of the pressure wave can be in a range between about 0 and about 800 Hz. The shape of the pressure wave can be modulated to a form similar to that of a sinusoidal waveform.

A method for reducing friction between a coiled tubing and a wellbore according to the present disclosure includes: generating a periodic pressure wave; coupling the periodic pressure wave to a coiled tubing in a wellbore; and propagating the periodic pressure change in the coiled tubing wherein a friction force between the coiled tubing and the wellbore is reduced. The waveform and/or the period of the periodic pressure wave can be modulated to a form similar to that of a sinusoidal waveform. The shape of the periodic pressure wave may also be modulated to forms other than those of sinusoidal waveforms.

BRIEF DESCRIPTION OF THE DRAWINGS

These and other features and advantages will be better understood by reference to the following detailed description when considered in conjunction with the accompanying drawings.

DETAILED DESCRIPTION OF SOME ILLUSTRATIVE EMBODIMENTS

Embodiments of the current application generally relate to systems and methods for generating pressure pulses for use in wellbores penetrating subterranean formations. The following detailed description illustrates embodiments of the application by way of example and not by way of limitation. All numbers disclosed herein are approximate values unless stated otherwise, regardless whether the word "about" or "approximately" is used in connection therewith. The numbers may vary by up to 1%, 2%, 5%, or sometimes 10% to 20%. Whenever a numerical range with a lower limit and an upper limit is disclosed, any number falling within the range is specifically and expressly disclosed.

Figure 1:
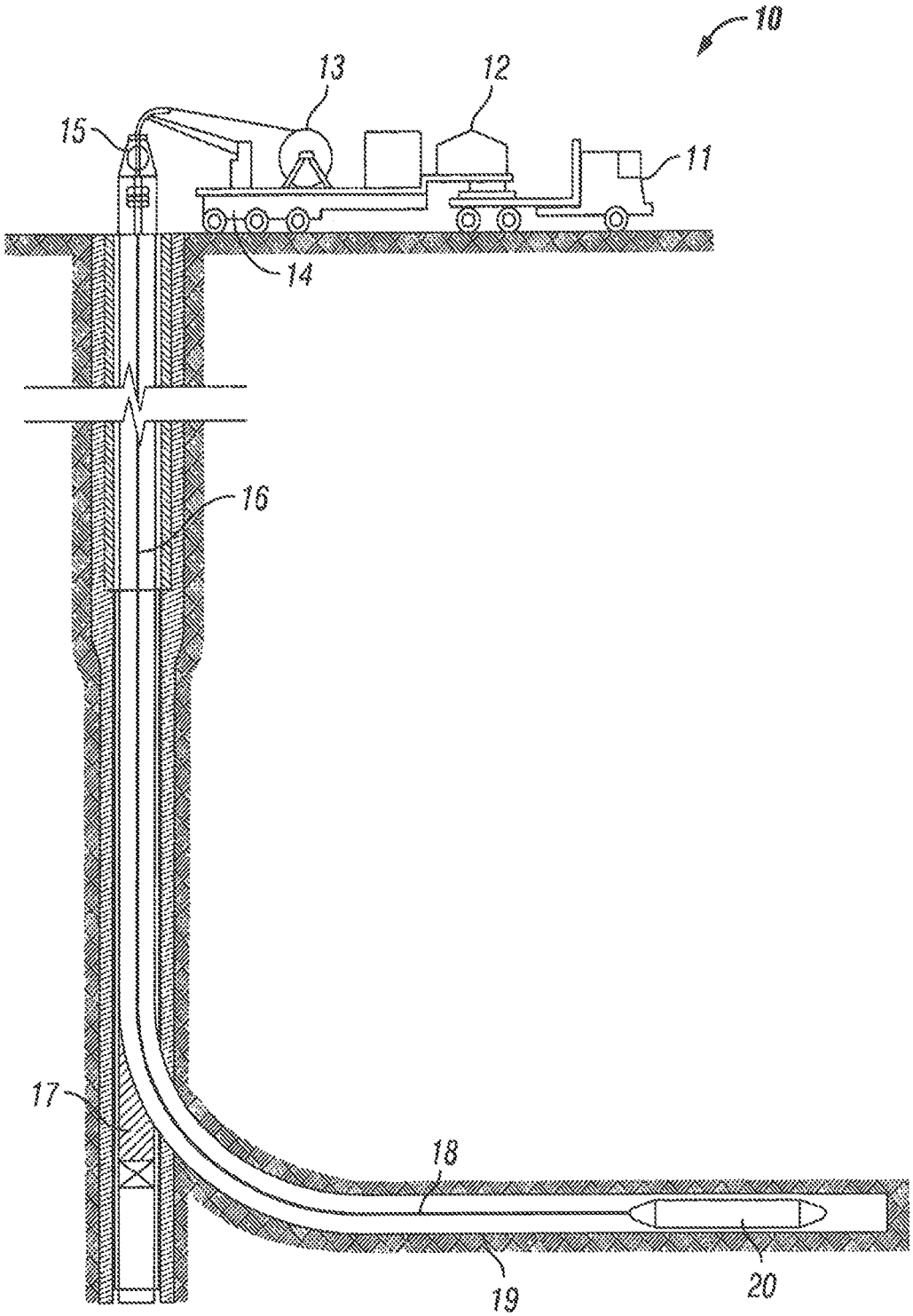
FIG. 1 is a schematic representation of a coiled tubing operating environment with a tube wave generating system according to one embodiment of the present disclosure.

FIG. 1 shows a typical coiled tubing operating environment of the present disclosure. In FIG. 1, a coiled tubing operation 10 comprises of a truck 11 and/or a trailer 14 that supports a power supply 12 and a tubing reel 13. While an on-land operation is shown, the method or device according to the present present disclosure is equally well suited for use in drilling for oil and gas as well and other coiled tubing operations both on land and offshore. Such trucks or trailers for coiled tubing operations are known. An injector head unit 15 feeds and directs coiled tubing 16 from the tubing reel into the subterranean formation. The configuration of FIG. 1 shows a horizontal wellbore configuration which supports a coiled tubing trajectory 18 from a vertical wellbore 17 into a horizontal wellbore 19. This present disclosure is not limited to a horizontal wellbore configuration. A downhole tool 20 is connected to the coiled tubing, as for example, to conduct flow or measurements, or perhaps to provide diverting fluids.

In the system and method of the present disclosure, a pressure pulse or pressure wave is applied to the inlet (at or near the injector head unit 15) of the coiled tubing 16 and allowed to propagate through the coiled tubing down to the bottom (or end of the coiled tubing in the wellbore at the tool 20). Alternatively, the pressure pulse may be generated downhole or generated in the annulus. Alternatively, the pressure pulse may be generated at the surface and applied to the annulus. Pulsing the inlet of the coiled tubing provides the satisfactory energy transfer downhole. In the case where the pressure pulse is higher than the continuous pumping pressure, the section of coiled tubing 16 that contains the pressure pulse is caused to expand relative to the rest of the coil and to get longer relative to sections that are at the continuous pumping pressure. In the case where the pressure pulse is lower than the continuous pumping pressure, the section of coiled tubing 16 that contains the pressure pulse is caused to shrink relative to the rest of the coil and to get shorter relative to sections that are at the continuous pumping pressure. Either condition, or a combination of them (including a specially shaped pulse train), will produce a traveling wave of motion going from the top of the coiled tubing 16 to the bottom.

EXAMPLES

Approximately 500 feet long pressure pulses were generated in an experiment. The pulses were able to travel through coiled tubing 16. These pulses were clearly audible as they went round and round on the spool and produced a noticeable jump and vibration in the top wraps of the reel 13 as they passed through.

The maximum positive pressure generated was about 6000 psi, due to the limitation of the hand pump used in the experiment. For negative pulses, the maximum pressure generated was about 5000 psi, due to the limitation of the full pumping pressure of the system. These pulses would return to surface through the annulus in essentially the same form that they were introduced to the coiled tubing.

Figure 2:
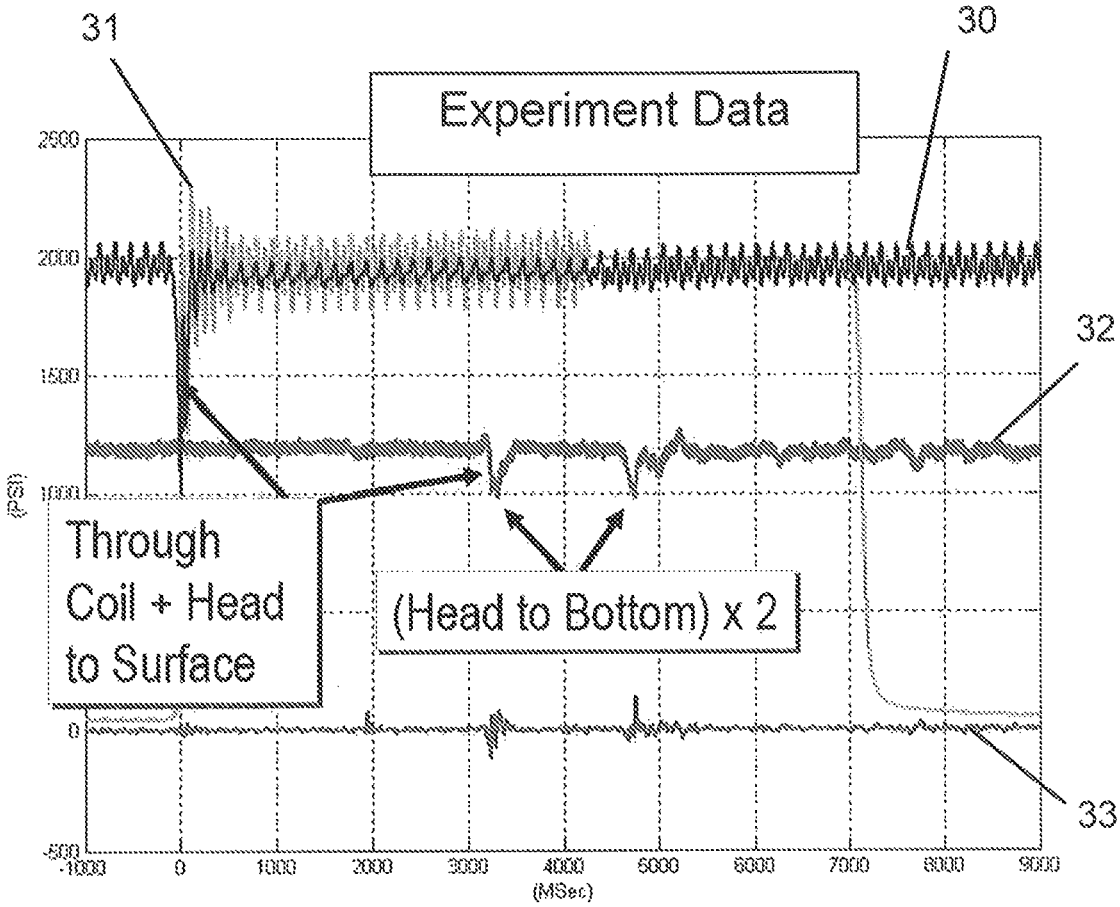
FIG. 2 is a diagram showing data recorded by using a tube wave generating system according to one embodiment of the present disclosure.

FIG. 2 is a diagram showing data recorded during the experiment. In this figure, the trace 30 is the pressure at the swivel. The trace 31 is the pressure in the joint of treating iron between the popper and fill valves. The trace 32 is well head pressure. The trace 33 is the wellhead pressure with the continuous pressure removed (AC only).

In an embodiment, a method comprises generating and propagating a period pressure wave or pressure pulse through the coiled tubing 16 at a predetermined frequency. The pressure wave frequency may be optimized in relation to total acoustic length of the coiled tubing, the helical buckling length or pitch of the coiled tubing and/or the length of the coiled tubing disposed in the wellbore. In an embodiment, the pitch may be in the range of about 10 to about 100 feet. In an embodiment, the pressure wave frequency may be optimized in relation to a sinusoidal buckling pitch of the coiled tubing, the minimum practical pulse length, and a length of the coiled tubing disposed in the wellbore.

In an embodiment, the efficacy of the method may be monitored by measuring at least one of an axial acceleration of the coiled tubing, such as at the wellsite surface or at the bottom hole assembly. The method may further be optimized based on the measured acceleration of the coiled tubing, such as by varying the generated period pressure wave, pressure pulse, or the like.

In an embodiment, a pump rate may be modulated such that pressure waves are produced up to (and above) the transit time of the coiled tubing such as by intentionally introducing one or more irregularities into each revolution of a crankshaft pump. In an embodiment, the pump may be throttled up (rpm increased) until all or part of the coiled tubing string is inflated by the increased pressure, after which the pump may be throttled down (rpm decreased) while the deflation propagates down the length of the coiled tubing. In a non-limiting example, the pumping speed of the pump may be modulated in the range of about 0 to about 400 rpm. In an embodiment, the pump modulation frequency may be about 3 to about 6 seconds, with some value seen in the range of about 0.5 second to about 60 seconds. The low end may be difficult to produce with pumps having diesel engine prime movers, but a hydraulic driven pump may be more easily able to modulate the flow rate this quickly.

Figure 3:
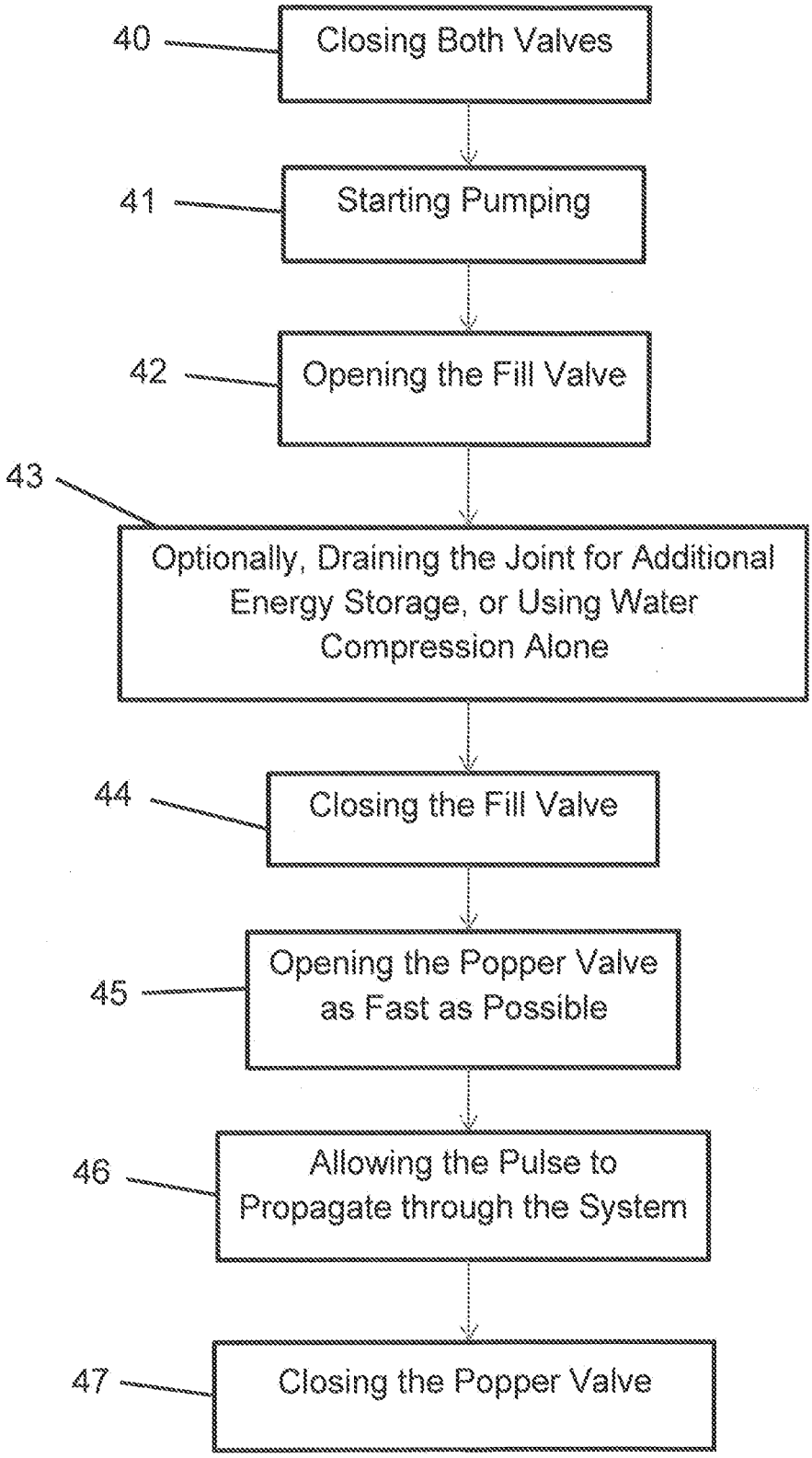
FIG. 3 is a flow diagram of a method according to one embodiment of the present disclosure.

The method disclosed herein may be particularly attractive in that it can be applied after the coiled tubing 16 is in hole and has become stuck. Also, it does not require special downhole tools and/or pre-job preparations. The pressure pulses can be generated with as little as two standard hammer valves and a joint of treating iron such as by passing a volume of fluid into or out of the pressure system via the volume of the joint of treating iron, discussed in more detail below. One hammer valve is the pulse generating valve (the "popper valve") and may be connected between the joint of treating iron and a point near the swivel. The other end of the joint has another hammer valve (the "fill" valve). A choke nipple on the outlet of the second valve can be optionally provided. In operation, the following steps may be performed as shown in the flow diagram of FIG. 3: Step 40 "closing both valves"; Step 41 "starting pumping"; Step 42 "opening the fill valve"; Step 43 "optionally, draining the joint for additional energy storage, or using water compression alone"; Step 44 "closing the fill valve"; Step 45 "opening the popper valve as fast as possible"; Step 46 "allowing the pulse to propagate through the system"; and Step 47 "closing the popper valve". The Steps 40-47 are repeated needed. A portion or the entire procedure described above can be automated.

Figure 4:
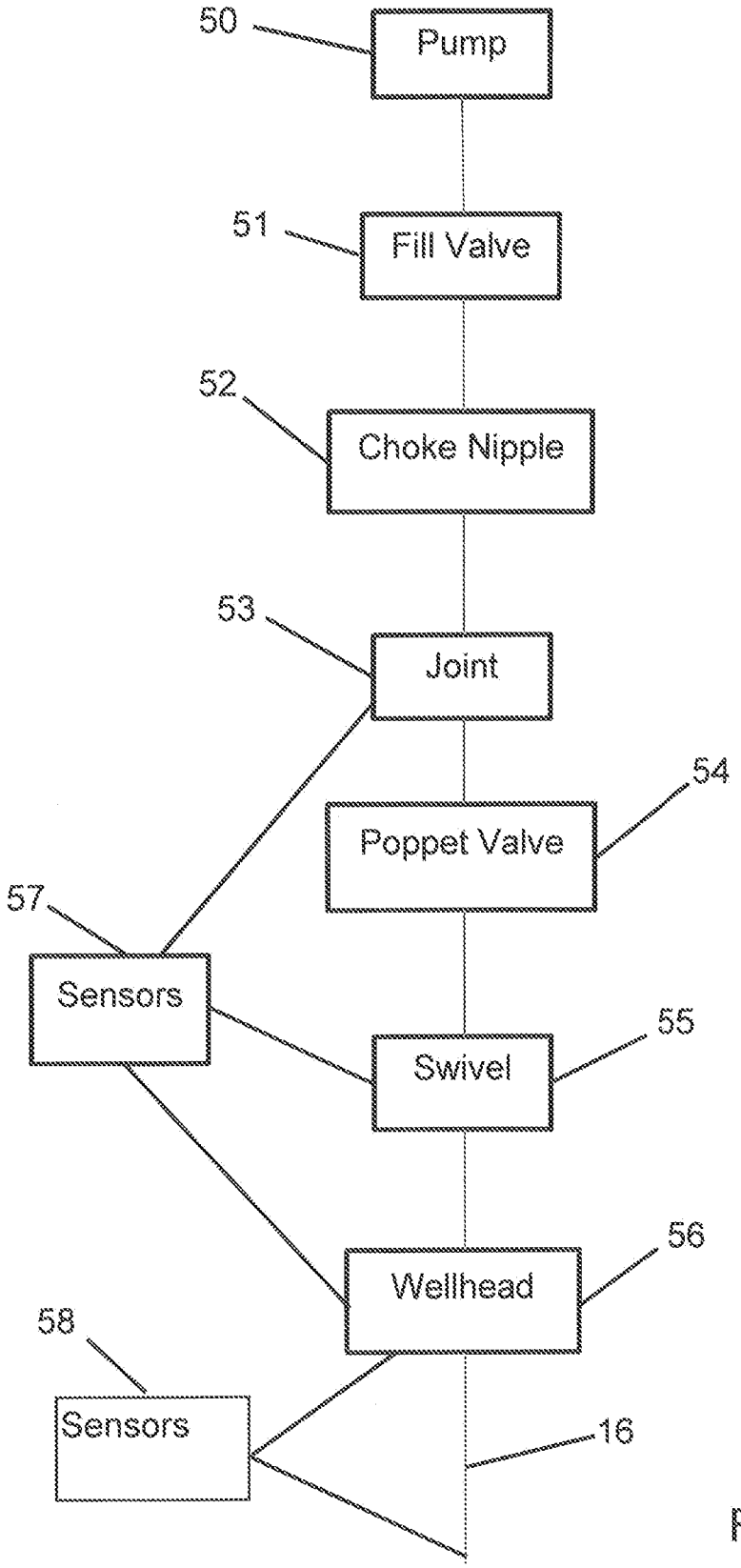
FIG. 4 is a schematic representation of an apparatus used to perform the method of FIG. 3.

FIG. 4 shows an embodiment of an apparatus or a system for generating the pressure pulses according to the method described above. A pump 50 provides a pressured fluid to an inlet of a fill valve 51 that can be a standard hammer valve. A choke nipple 52 on the outlet of the fill valve 51 can be optionally provided. The pressured fluid flows to a joint 53 of treating iron. Another hammer valve 54 is the pulse generating valve (the "popper valve") and may be connected between the joint 53 of treating iron and a point near a swivel 55. The swivel 55 is connected to a wellhead 56 at which is positioned the upper end of the length of the coiled tubing 16 extending down the wellbore. The method of generating a pressure wave, introducing the pressure wave to the coiled tubing 16, and propagating the pressure wave within the coiled tubing can be accomplished by modulating the operating of the pump 50 attached to the coiled tubing.

A plurality of pressure sensors 57 is provided as shown in FIG. 4. One of the sensors 57 measures the fluid pressure at the swivel 55 as shown in the trace 30 of FIG. 2. Another one of the sensors 57 measures the fluid pressure at the joint 53 as shown in the trace 31 of FIG. 2. Yet another one of the sensors 57 measures the fluid pressure at the wellhead 56 as shown in the trace 32 of FIG. 2.

One or more acceleration sensors 58 are provided as shown in FIG. 4. One of the sensors 58 can measure axial acceleration of the coiled tubing 16 the wellsite surface (such as at the wellhead 56). Another one of the sensors 58 can measure axial acceleration of the coiled tubing 16 the bottom hole assembly (such as at the tool 20 in FIG. 1). The sensor 58 at the bottom hole assembly can also or instead measure axial force applied to the coiled tubing 16. The measured axial acceleration and/or axial force are/is used to adjust the generated pressure wave.

At one extreme, a pressure pulse whose dimensions are comparable to the diameter of the coiled tubing will have little or no useful effect due to the small length of coiled tubing moving when the pressure wave passes through. However, the other extreme where the pressure pulse is comparable to or exceeding the full length of the coiled tubing string is a useful configuration if dynamic friction can be produced between the coiled tubing and the well bore. Based on the pressure magnitudes discussed above, the physical motion of the coiled tubing associated with the passage of such a pulse may be significant. Such pulses have been both visually observed and heard passing though a coiled tubing reel during experimental trial.

The preceding description has been presented with reference to some embodiments. Persons skilled in the art and technology to which this disclosure pertains will appreciate that alterations and changes in the described structures and methods of operation can be practiced without meaningfully departing from the principle, and scope of this application. Accordingly, the foregoing description should not be read as pertaining only to the precise structures described and shown in the accompanying drawings, but rather should be read as consistent with and as support for the following claims, which are to have their fullest and fairest scope.

What is claimed is:

1. A method for reducing friction between a coiled tubing and a wellbore comprising:

generating a pressure wave at an inlet of the coiled tubing at an oilfield surface with surface equipment attached to the coiled tubing;

introducing the pressure wave to the coiled tubing positioned in the wellbore, wherein said introducing comprises applying the pressure wave to an annulus of the wellbore; and propagating the pressure wave within the coiled tubing, wherein the pressure wave reduces a friction force between the coiled tubing and the wellbore.

2. The method of claim 1 wherein generating comprises generating the pressure wave at about 500 feet long in wavelength.

3. The method of claim 1 wherein generating comprises generating the pressure wave as a positive pressure pulse exceeding a continuous pressure in the coiled tubing.

4. The method of claim 3 wherein the positive pressure pulse is up to about 6000 psi in pressure.

5. The method of claim 1 wherein generating comprises generating the pressure wave as a negative pressure pulse less than a continuous pressure in the coiled tubing.

6. The method of claim 5 wherein the negative pressure pulse is up to about 5000 psi in pressure.

7. The method of claim 1 wherein generating comprises generating the pressure wave by operating two valves at an oilfield surface in fluid connection by a joint of treating iron.

8. The method of claim 1 wherein generating comprises generating the pressure wave at a predetermined frequency or a predetermined wavelength.

9. The method of claim 8 wherein the predetermined frequency is determined in relation to at least one of a total acoustic length of the coiled tubing, a helical buckling pitch of the coiled tubing, and a length of the coiled tubing disposed in the wellbore.

10. The method of claim 1 further comprising measuring an axial acceleration of the coiled tubing and adjusting the generated pressure wave based on the measured acceleration.

11. The method or claim 10 wherein measuring comprises measuring the axial acceleration of the coiled tubing at a wellsite surface or a bottom hole assembly.

12. The method of claim 1 wherein generating, introducing, and propagating comprises modulating operation of a surface equipment pump attached to the coiled tubing.

13. The method of claim 12 wherein modulating operation of the pump comprises intentionally introducing one or more irregularities into each revolution of a crankshaft pump.

14. The method of claim 1 further comprising measuring an axial force at a downhole end of the coiled tubing and adjusting the generated pressure wave based on the measured axial force.

15. The method of claim 1 wherein a frequency of the pressure wave is adjusted based on a length of the coiled tubing in the wellbore.

16. The method of claim 1 wherein a frequency of the pressure wave is in a range between about 0 and about 800 Hz.

17. The method of claim 1 wherein a shape of the pressure wave is modulated to a form similar to that of a sinusoidal waveform.

18. A method for reducing friction between a coiled tubing stuck in a wellbore comprising:

generating a periodic pressure wave at an inlet of the coiled tubing at an oilfield surface with surface equipment attached to the coiled tubing, wherein said generating comprises generating the periodic pressure wave by operating two valves at an oilfield surface in fluid connection by a joint of treating iron;

coupling the periodic pressure wave to the coiled tubing stuck in the wellbore; and propagating the periodic pressure wave change in the coiled tubing, wherein a friction force between the coiled tubing and the wellbore is reduced and changed to a dynamic friction.

19. The method of claim 18 wherein a waveform or a period of the periodic pressure wave is modulated to a form similar to that of a sinusoidal waveform.

* * * * *